US007260974B2

(12) United States Patent
Koch et al.

(10) Patent No.: US 7,260,974 B2
(45) Date of Patent: Aug. 28, 2007

(54) BENDING MACHINE, ESPECIALLY BENDING OR FOLDING PRESS, COMPRISING AN ADJUSTABLE LOWER TOOL

(75) Inventors: Gerald Koch, Asperg (DE); Thomas Gerber, Emmendingen-Mundingen (DE); Thomas Fehrenbach, Gutach-Siegelau (DE)

(73) Assignee: Trumpf Maschinen Austria GmbH & Co KG, Pasching (AT)

( * ) Notice: Subject to any disclaimer, the term of this patent is extended or adjusted under 35 U.S.C. 154(b) by 383 days.

(21) Appl. No.: 10/499,723

(22) PCT Filed: Dec. 3, 2002

(86) PCT No.: PCT/EP02/13656

§ 371 (c)(1),
(2), (4) Date: Sep. 9, 2004

(87) PCT Pub. No.: WO03/053605

PCT Pub. Date: Jul. 3, 2003

(65) Prior Publication Data

US 2005/0050937 A1 Mar. 10, 2005

(30) Foreign Application Priority Data

Dec. 21, 2001 (DE) ..... 101 63 498

(51) Int. Cl.
*B21D 43/26* (2006.01)

(52) U.S. Cl. ..... 72/389.4; 72/461; 72/31.12

(58) Field of Classification Search ..... 72/461, 72/389.4, 477, 31.12, 448, 421, 420
See application file for complete search history.

(56) References Cited

U.S. PATENT DOCUMENTS

| | | | | |
|---|---|---|---|---|
| 3,675,463 | A * | 7/1972 | Munschauer et al. | 72/448 |
| 3,812,695 | A | 5/1974 | Roch | |
| 3,874,205 | A * | 4/1975 | Roch et al. | 72/17.2 |
| 4,188,815 | A | 2/1980 | Mizushima | |
| 4,411,150 | A * | 10/1983 | Klein et al. | 72/461 |
| 5,501,095 | A * | 3/1996 | Dilger et al. | 72/461 |
| 6,656,099 | B1 | 12/2003 | Akami et al. | |

FOREIGN PATENT DOCUMENTS

| | | |
|---|---|---|
| CH | 432437 | 9/1967 |
| DE | 1 931 714 | 1/1971 |
| DE | 7139889 | 2/1972 |
| DE | 86 28 989.6 | 3/1987 |
| DE | 37 45 026 | 3/1997 |
| DE | 37 45 067 | 3/1997 |
| DE | 196 81 349 T1 | 4/1998 |
| DE | 198 40 563 | 12/1999 |
| EP | 0 079 138 | 10/1982 |
| EP | 05 30 375 B1 | 3/1993 |
| EP | 06 50 782 B1 | 5/1995 |
| EP | 0919301 A1 | 6/1999 |
| FR | 89367 | 5/1967 |

* cited by examiner

*Primary Examiner*—Derris H. Banks
*Assistant Examiner*—Debra M Wolfe
(74) *Attorney, Agent, or Firm*—Volpe and Koenig, P.C.

(57) ABSTRACT

A bending machine (1) is provided wherein components of the existing abutment system, namely a drive part or a carriage (7), which can be directly or indirectly detachably coupled to the lower tool, are used instead of an additionally integrated device (axle) for displacing lower tools (2) transversely in relation to their length. In this way, the existing axle of the abutment system can also be used to adjust the tool.

11 Claims, 4 Drawing Sheets

BENDING MACHINE, ESPECIALLY BENDING OR FOLDING PRESS, COMPRISING AN ADJUSTABLE LOWER TOOL

BACKGROUND

The invention relates to a bending machine, especially a bending or folding press, with a lower tool and with an upper tool that can be adjusted vertically relative to the lower tool. One of the tools has one or more parallel notches or grooves and by means of the motion of the upper tool, a workpiece is pressed and thus bent in these notches or grooves. Here, the lower tool can be adjusted perpendicular to its longitudinal extent or perpendicular to the bending line and the bending machine has at least one stop for the workpiece. This stop is arranged in the region of the plane of the lower tool and can be adjusted in its distance relative to this lower tool.

Bending machines of the previously mentioned type are known in many different variants and an example for a bending machine that works according to the mentioned principle is described in DE 198 40 563 C1. Frequently, the lower tool is formed as a mold with several notches or grooves, if necessary with moveable stops, in order to be able to take into account different material thicknesses and/or different bending angles. Furthermore, in many cases a groove on the lower tool is used for pre-bending and an edge of the lower tool parallel to the groove or grooves is used for closing or folding. In addition, it is known to provide a bending machine with several processing stations, which are provided with the same upper tool or with different upper tools and which have different lower tools, which have grooves and/or deformation edges arranged differently opposite the upper tool or tools.

In such cases, the lower tool or its mount can be adjusted relative to the upper tool or tools perpendicular to the longitudinal extent of the bending lines or grooves. However, it is also conceivable to place the parallel grooves in the upper tool and nevertheless to form the lower tool so that it can be adjusted perpendicular to the longitudinal extent of the grooves and the bending line for adjusting relative to the upper tool.

For perpendicular adjustment of the lower tool, at least two spaced driving units are necessary to permit exact parallel displacement.

SUMMARY

The invention is based on the objective of reducing the machine expense for perpendicular displacement or perpendicular adjustment of the lower tool.

To address this object, the bending machine defined in the introduction is characterized in that the lower tool can be detachably coupled directly or indirectly to the adjustment drive for the adjustable stop, which can adjust the distance of the stop from the lower tool when the coupling is detached.

In a surprising way, the drive for the perpendicular adjustment of the stop takes on an additional function in that it is also used to adjust the lower tool, if necessary, perpendicular to the bending line. In this way, separate drives for the perpendicular adjustment of the lower tool can be eliminated advantageously, including their controls, and above all also including their space requirements. Thus, the drive components of the existing abutment system can be used to adjust the lower tool. This has the additional advantage that each position of the lower tool can move continuously, also automatically, and can be adjusted, while with conventional, usually pneumatic, adjustment devices, only predetermined set positions can be assumed. Thus, the usability is improved considerably, because the user can use a wide range of different tools and does not have to match the distances of the grooves or notches. Here, the direct or indirect connection of the lower tool to the adjustment drive for the stop can be realized on different parts, in different positions, and in different ways.

In one possible embodiment of the invention, the direct or indirect coupling between the lower tool and the drive for the stop can be realized by an element that can be brought into transverse contact with the stop. However, this means that the adjustment must be performed against a restoring force or the stop must be brought into different, opposing positions each in transverse contact to also generate an opposite adjustment.

Therefore, it is preferable to have a detachable coupling, which is effective in both opposing adjustment directions of the lower tool. Thus, the drive of the stop can move in an arbitrary direction after production of the mentioned coupling in order to generate opposite adjustment movements on the lower tool.

The coupling can also use magnetic forces or also force-fits, but for defined adjustment movements, a positive-fit coupling for detachable coupling of the lower tool or its mount with the drive for the stop can be provided.

In one possible configuration of the invention, the stop finger or fingers of the adjustable stop can be used themselves as coupling parts and can be attached detachably by means of magnets, pins, projections, or the like to the lower tool or, preferably, to its mount or to a counter opening in the mount. This represents an especially simple possibility for coupling the lower tool or its mount when necessary indirectly to the drive for the adjustable stop.

Due to the adjustability according to the invention, which advantageously can be configured continuously, the lower tool can have several parallel notches and/or grooves, because these can all be brought into a usable position in a simple way.

In one configuration of the invention, rods or bars, which extend perpendicular to the longitudinal extent of the lower tool or its mount, especially at a right angle to the bending line and especially approximately horizontal, are attached, especially rigidly, to the lower tool or its mount, to which the drive for the stop or a part connected to this drive can be detachably coupled, especially clamped. If the coupling or clamp is detached, the drive for the stop can adjust the stop perpendicular to the bending line. However, if the lower tool is to be adjusted, only the clamps on the corresponding rods have to be set in operation, wherein activating the drive in turn adjusts these clamps, which then carry along the corresponding rods or bars and thus also the lower tool.

The clamp for gripping a rod or bar connected to the lower tool or its mount can surround this part with a guidance opening or like grippers also in the detached position and can be moved relative to the rod or bar in the detached position. Thus, the coupling motion must include only the closing of the clamp. In this way, it is advantageous when this clamp or coupling is arranged on a part of the stop, relative to which the stop itself can be adjusted in height, for example, so that the functions of the stop itself remain independent of the temporary coupling with the lower tool.

The rods or bars attached to the lower tool or its mount can engage in a second clamping device, relative to which they can be adjusted in the open position of this second clamping device, and which are closed for a preselected position of the tool and are opened for adjustment of the tool with the help of the first clamp or clamping device. Thus, with a second clamping device, a set position of the lower tool can be provided simply in the manner of a clamp and on the same connection means, namely the rods or bars, which requires minimal machine expense and minimal space requirements.

However, other detachable couplings between the drive of the stop and the lower tool are also conceivable.

For example, for detachable coupling of the lower tool or its mount to the drive of the stop, a pivot arm with a projection or a recess can be provided on one of the two parts and a recess or a projection can be provided on the other part for detachable connection to the pivot arm as connection means. Here, advantageously this coupling is also provided on one part of the drive of the stop, which itself is adjustable only perpendicular to the lower tool, while other adjustment movements of the stop, e.g., height adjustments, can be performed relative to this part.

The pivot arm can pivot up and down on the drive for the stop in an especially vertical plane and with a peg it can pivot into a hole in a counter bar, which is connected to the lower tool or its mount, or the pivot arm can have a hole, which detachably coincides with a projection or peg on a counter piece connected to the lower tool or its mount in the usable position.

Overall, combining one or more of the previously described features and means has the primary result of also allowing the drive components of the existing abutment system of a bending machine defined in the introduction to be used for adjusting the lower tool relative to the upper tool. Here, an already existing unit of the drive for the stop, usually a carriage that can be adjusted back and forth perpendicular to the bending line, is simply connected or latched or coupled and thus an additional function, which in an especially favorable way also permits continuous adjustment, is imparted to this drive. The use of the drive or an associated adjustment carriage or the like for the abutment system also for displacing or positioning the lower tool eliminates separate drive units for adjusting the lower tool and allows corresponding room for other devices that can be attached to the bending machine.

BRIEF DESCRIPTION OF THE DRAWINGS

In the following, embodiments of the invention are described in more detail with reference to the drawing. Shown in partially schematic representation are.

DETAILED DESCRIPTION OF THE PREFERRED EMBODIMENTS

Figure 1:
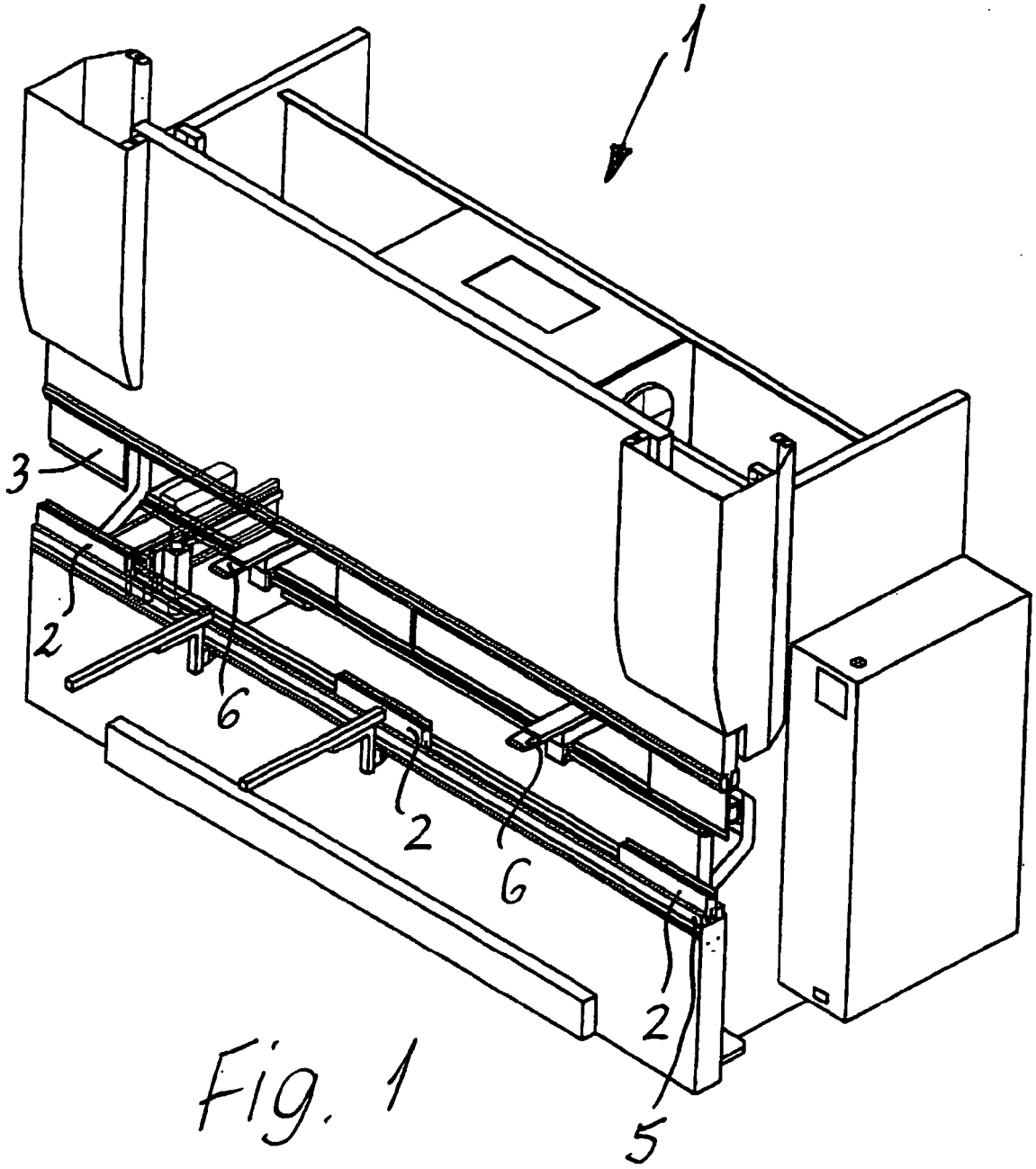
FIG. 1 is a perspective view of a bending machine with a mount for the lower tool or tools, wherein the mount can be adjusted perpendicular to the longitudinal extent of the tools.
Figure 2:
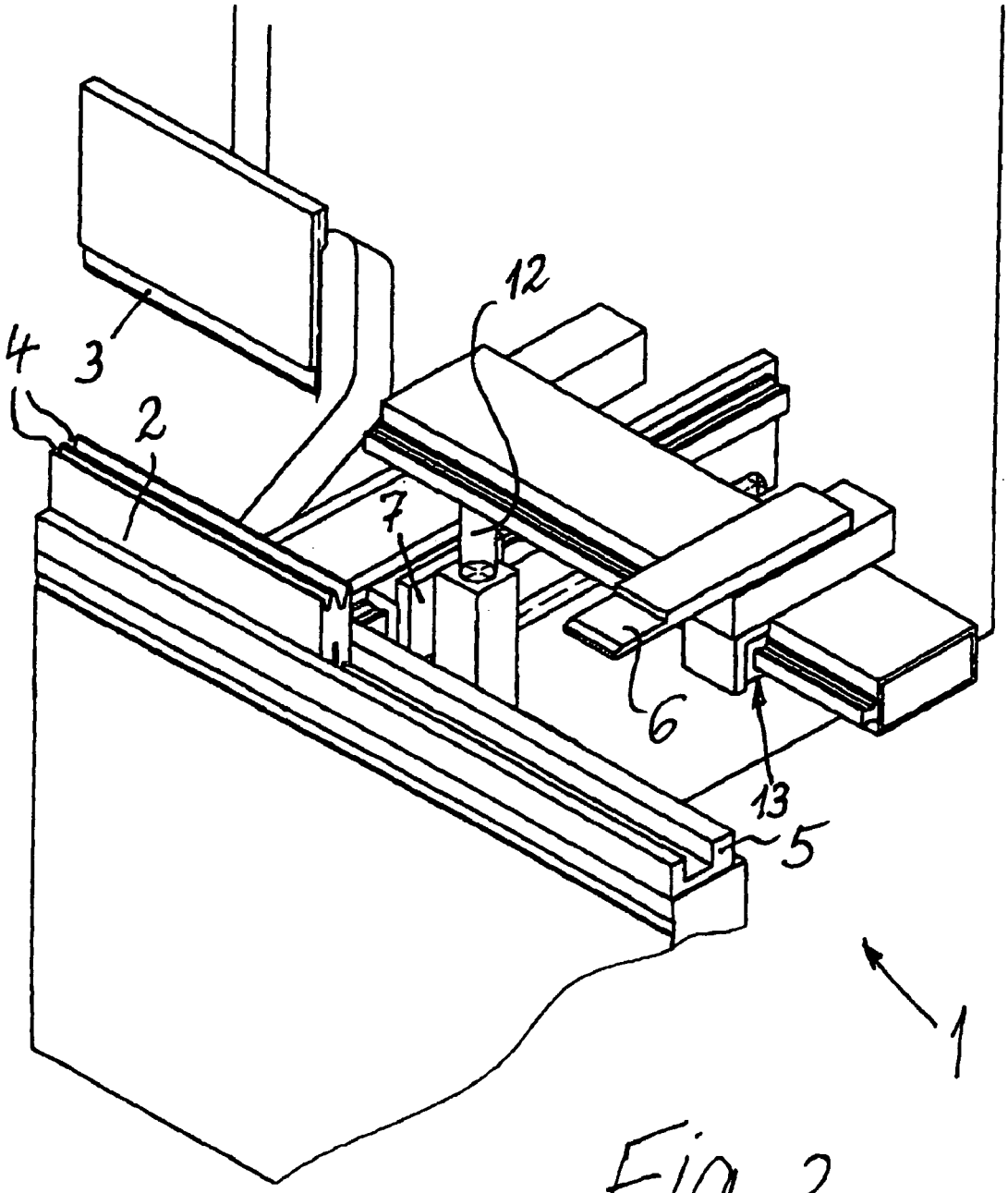
FIG. 2 is an enlarged scale, perspective view of the mount of the lower tool, the adjustable stop, and a device for an adjusting motion of the lower tool perpendicular to its longitudinal extent.

A bending machine designated as a whole with 1 is formed as a bending or folding press. It has a lower tool 2 including optionally several parts according to FIG. 1 and an upper tool 3, which can move against this lower tool from top to bottom. Here, the lower tool or tools 2 have according to FIGS. 2-7, one or more, in this embodiment two, parallel notches or grooves 4, and due to the movement of the upper tool 3, a workpiece, not shown in more detail, can be pressed and thus bent in such a groove 4 located exactly underneath the upper tool 3.

A mount 5 for the lower tool 2 is adjustable, as described hereinafter, perpendicular to the longitudinal extent of the lower tool 2 and perpendicular to the bending line for adaptation to the parallel grooves 4, so that selectively one or the other groove 4 comes to lie exactly underneath the upper tool 3, so that the bending of a workpiece can be performed selectively on the different grooves 4. Here, the lower tools 2 even have grooves 4 on both sides and can also be used rotated by 180° about their longitudinal axis.

Here, the bending machine 1 also has a stop 6, which is arranged in the plane of the lower tool 2 and which can be adjusted in its distance opposite this lower tool 2 and also in height, for the workpiece, which is not shown in more detail. This stop 6 can be seen both in FIG. 2 and also in FIGS. 1, 3, and 6. For adjusting the stop 6 perpendicular to the bending line, a carriage 7 is provided, whose possible back and forth motion is shown in FIGS. 3, 5, 6, and 7 by a double-headed arrow.

In all of the embodiments, the lower tool 2 can be coupled detachably directly or indirectly to the adjustment drive and in this way to the carriage 7 for the adjustable stop 6, so that with the help of this drive for the stop 6, thus with the help of the carriage 7, the lower tool 2 can be adjusted perpendicular to its longitudinal extent, while during a detached coupling with this adjustment drive and the carriage 7, the distance of the stop 6 from the lower tool 2 can be adjusted in a known way. Here, a spindle 8 or a different drive for linear movements, with which the carriage 7 can be moved back and forth, also belong to this adjustment drive according to FIGS. 3, 5, 6, and 7.

The connection or coupling between the lower tool 2 or a mount 5 and the drive 7 for the stop 6 could be produced by transverse contact, for which a corresponding element is provided with the stop 6 or its drive 7. However, in the embodiments, a detachable coupling to be described in even more detail is provided, which is active in both opposite displacement directions according to the double-headed arrows in FIGS. 3, 5, 6, and 7. Here, a positive-fit or force-fit connection or coupling for detachable coupling of the lower tool 2 or its mount 5 to the drive 7 for the stop 6 is provided. Here, the embodiments show lower tools 2 each with two parallel notches or grooves 4, but more and/or differently shaped notches could also be provided, because the adjustable drive or carriage 7 for the stop 6 can also be adjusted continuously.

Figure 3:
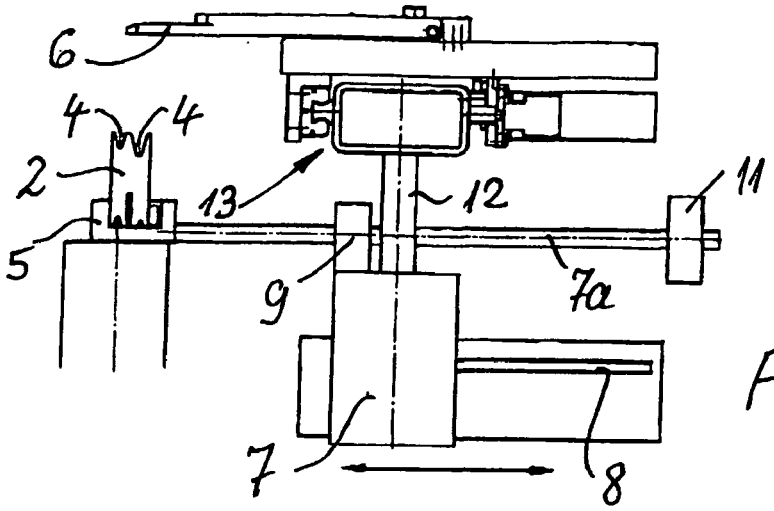
FIG. 3 is a side view of a carriage for adjusting the stop perpendicular to the bending line and to the lower tool, which carries a unit for adjusting the stop also parallel to the bending line and a coupling for connecting to a rod, which is arranged perpendicular to the profile of the lower tool and which is connected to this tool.
Figure 4:
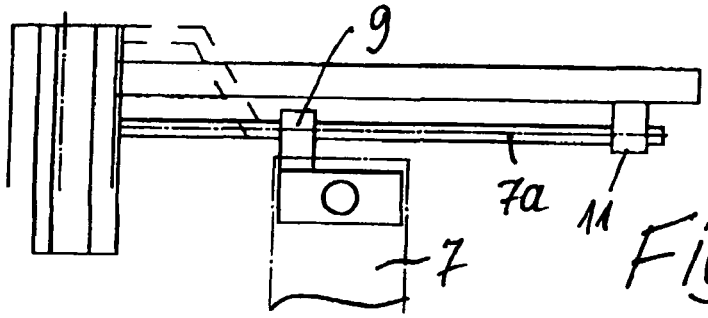
FIG. 4 is an arrangement corresponding to FIG. 3, which shows that the rod engaging the mount for the lower tool engages a different position than according to FIG. 3 and if necessary can also be crimped or bent in some other way in certain regions.
Figure 5:
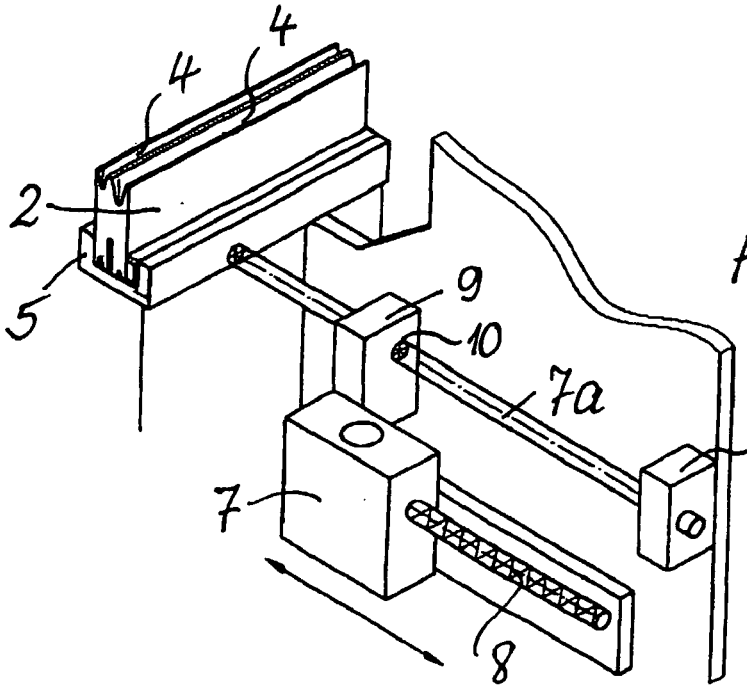
FIG. 5 is a perspective view of the arrangement according to FIG. 3 in relation to a part of the machine frame.

For the embodiment according to FIGS. 3-5, rods 7*a*, which extend perpendicular to the longitudinal extent of the lower tool and simultaneously at a right angle to the bending line and approximately horizontal, are attached to the lower tool 2 indirectly by means of its mount 5. The drive or carriage 7 for the stop 6 can be coupled detachably, in the embodiment clamped, to these rods. In this embodiment, the clamp 9 for gripping the rod 7*a* connected directly or indirectly to the lower tool 2 or its mount 5 can be seen schematically. In this way, the clamp 9 covers this rod 7*a* with a guidance opening 10, through which the rod 7*a* extends also in the detached position, so that for an opened clamp 9, displacement of the carriage 7 and the stop 6 relative to the rod 7*a* is possible.

The rods 7*a* or bars attached to the lower tool 2 or its mount 5 directly or indirectly here engage in a second clamping device 11, which is at a distance from the clamp 9. The rods 7*a* can be shifted or adjusted relative to these second clamping devices 11, if these clamping devices 11 are open. If the lower tool 2 has a desired position, this second clamping device 11 can be closed in order to fix this position. The first clamp or clamping device 9 can then be opened in order to be able to adjust the stops 6 in terms of its distance to the lower tool 2 for a fixed lower tool 2. The clamp 9 and the clamping device 11 are here shown only schematically, i.e., the actual clamp backs or clamping elements are arranged in the interior of the associated housing.

Above all, the clamp 9 connected to the drive or carriage 7 is here arranged spatially so that this carriage 7 is located next to the rod 7*a* and a guide 12 can be moved up and down relative to this carriage 7, where this guide carries the actual bearing 13 of the stop 6, on which the stop 6 is also adjustable in the longitudinal direction. The guide 12 also allows the known height adjustment of the stop 6 independent of the fact that the drive 7 for the stop 6 can also be used for adjusting the lower tool 2.

Figure 6:
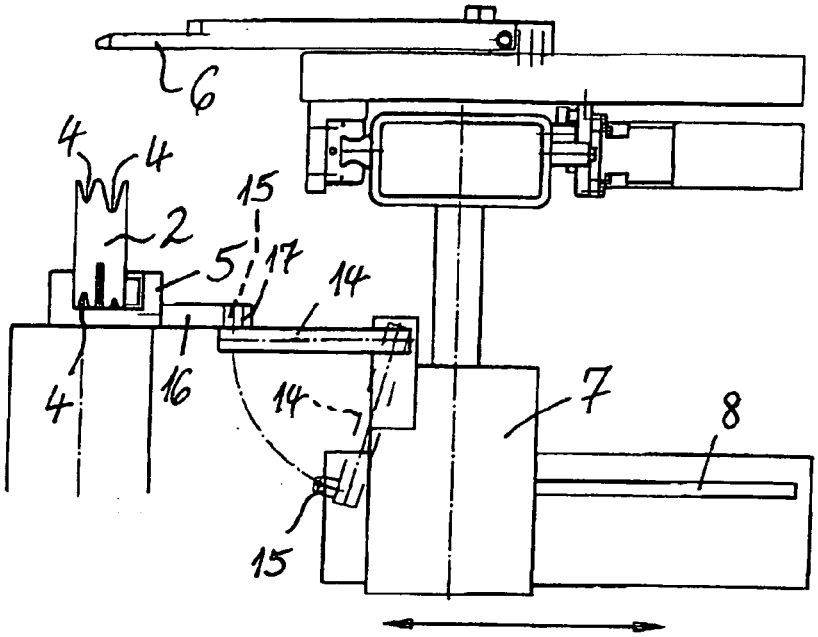
FIG. 6 is a representation corresponding to FIG. 3, namely a side view of a modified embodiment, for which the carriage that can be adjusted perpendicular to the bending line for the adjustment device for the stop can be coupled by means of a pivot arm to a counter piece arranged on the mount for the lower tool.
Figure 7:
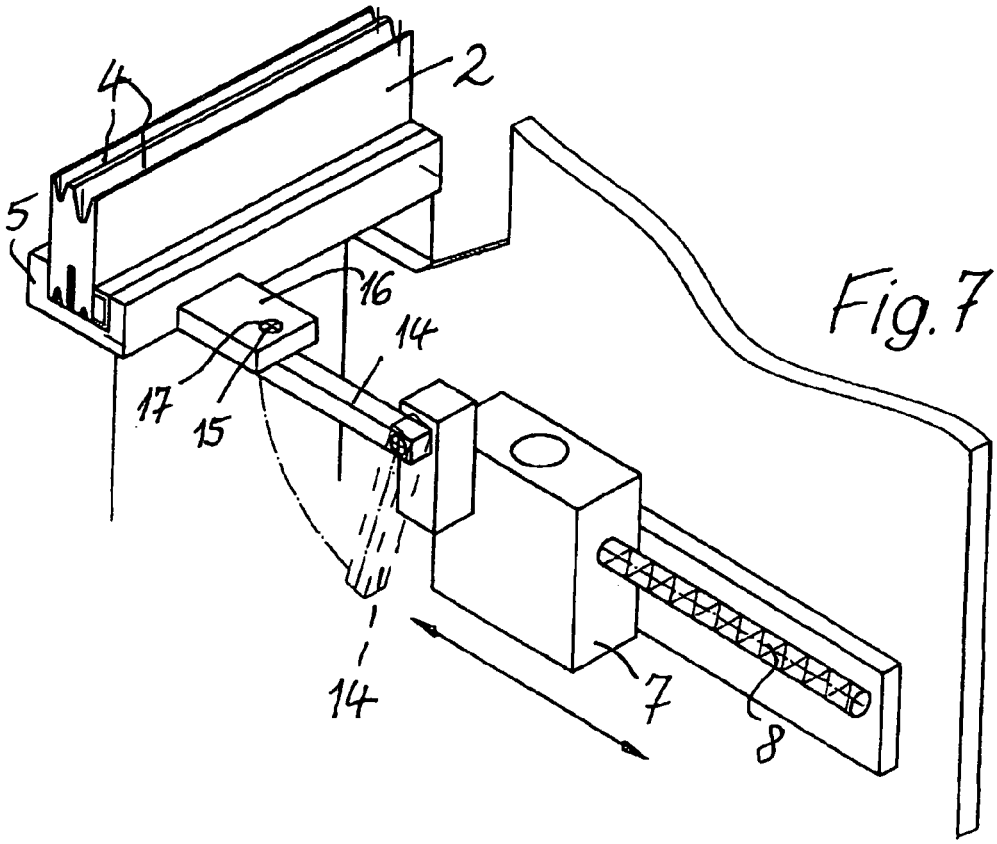
FIG. 7 is a perspective view of the arrangement according to FIG. 6.

In FIGS. 6 and 7, as connection means for detachable coupling of the lower tool 2 or its mount 5 with the drive 7 of the stop 6, one of the two parts, namely the drive 7, has a pivot arm 14 with a projection 15, and the other part, namely a counter piece 16 connected directly or indirectly to the lower tool 2, has a recess 17 for detachable connection to the pivot arm 14, wherein the projection 15 of the pivot arm 14 fits into the recess 17. However, it would also be conceivable that the pivot arm 14 has a recess and the counter piece 16 has a matching projection and/or that the pivot arm 14 is arranged directly or indirectly on the mount 5 and the counter piece 16 is arranged on the drive 7.

In this embodiment, the pivot arm 14 can pivot up and down on the drive 7 for the back and forth adjustment of the stop 6 perpendicular to the bending line in an approximately vertical plane and can pivot with a projection 15 formed as a peg into a matching recess 17 in the counter piece 16 formed as a counter plate, wherein the two positions of the pivot arm 14 are shown with different lines. The coupling position with an approximately horizontal arrangement of the pivot arm 14 is shown with continuous lines and the decoupled position is shown with broken lines.

Instead of an additional installed device (axle) for adjusting the lower tools 2 perpendicular to their extent, components of the existing abutment system, namely a drive part or carriage 7, which can be coupled detachably directly or indirectly to the lower tool 2, are used in the bending machine 1. Therefore, this existing axle of the abutment system can also be used for adjusting the tool.

The invention claimed is:

1. Bending machine (1), comprising a lower tool (2) and an upper tool (3), which can be adjusted vertically relative to the lower tool, one of the tools (2) has one or more parallel notches or grooves (4) and by vertical movement of the upper tool (3) a workpiece is pressed and therefore bent in the notches or grooves (4), the lower tool (2) is adjustable perpendicular to a longitudinal extent thereof or perpendicular to a bending line, and the bending machine (1) has at least one adjustable stop (6) for the workpiece, the stop is arranged in a region of a plane of the lower tool (2) and can be adjusted in distance relative to the lower tool (2), the lower tool (2) is operatively coupled to an adjustment drive for the adjustable stop (6), and operatively decoupleable from the adjustment drive for adjustment of a horizontal distance of the stop from the lower tool.

2. Bending machine according to claim 1, wherein the coupling between the lower tool (2) and the drive (7) for the stop (6) is provided by an element that can be brought into transverse contact with the stop.

3. Bending machine according to claim 1, wherein a detachable coupling is provided, which is active in both opposing displacement directions of the lower tool.

4. Bending machine according to claim 1, wherein a positive-fit or force-fit coupling for detachable coupling of the lower tool (2) or a mount (5) of the lower tool to the drive (7) for the stop (6) is provided.

5. Bending machine according to claim 1, wherein a stop finger or fingers of the adjustable stop are used as coupling parts and are coupled to a mount for the lower tool.

6. Bending machine according to claim 1, wherein the lower tool (2) includes several parallel notches and/or grooves (4).

7. Bending machine according to claim 1, wherein rods (7*a*) or bars, which extend perpendicular to the longitudinal extent of the lower tool or a mount (5) thereof, or at a right angle to the bending line, are attached, to the lower tool (2) or the mount (5), wherein the drive (7) for the stop (6) or a part connected to the drive can be coupled detachably or clamped to the rods or bars.

8. Bending machine according to claim 7, wherein a clamping device (9) for gripping rods or bars connected to the lower tool (2) or a mount (5) thereof surrounds the rods or bars with a guidance opening (10) or like grippers also in the detached position and in the detached position can be shifted relative to the rods (7*a*) or bars.

9. Bending machine according to claim 8, wherein the rods (7*a*) or bars attached to the lower tool (2) or a mount (5) thereof engage a second clamping device (11), to which they can be adjusted relatively in an open position of the second clamping device (11), and which is/are closed for a preselected position of the tool (2) and opened for adjusting the tool with the help of the first clamping device (9).

10. Bending machine according to claim 1, wherein as connection means for detachable coupling of the lower tool (2) or a mount (5) thereof with the drive (7) of the stop (6), one of the two parts has a pivot arm with a projection (15) or a recess and the other part (16) has a recess (17) or a projection for detachable connection with the pivot arm (14).

11. Bending machine according to claim 10, wherein the pivot arm (14) on the drive (7) for the stop (6) can pivot up and down in a generally vertical plane and can pivot with a peg (15) into a recess (17) on the other part which comprises a counter bar or counter plate (16), which is connected to the lower tool or the mount, or the pivot arm has a hole, which surrounds detachably a projection or peg on the other piece connected to the lower tool or the mount in the usable position.

* * * * *